US006699060B1

(12) United States Patent
Scott

(10) Patent No.: US 6,699,060 B1
(45) Date of Patent: Mar. 2, 2004

(54) ELECTRICAL OUTLET PROTECTION DEVICE

(76) Inventor: Raven C. Scott, 3249 Yosemite Ave., Baltimore, MD (US) 21215

( * ) Notice: Subject to any disclaimer, the term of this patent is extended or adjusted under 35 U.S.C. 154(b) by 0 days.

(21) Appl. No.: 10/286,288

(22) Filed: Nov. 4, 2002

(51) Int. Cl.[7] ..... H01R 13/64
(52) U.S. Cl. ..... 439/373
(58) Field of Search ..... 439/135, 373, 439/147; 174/67

(56) References Cited

U.S. PATENT DOCUMENTS 2,761,112 A * 8/1956 Torcivia
D283,221 S * 4/1986 West ..... D13/30
5,174,773 A * 12/1992 Jones ..... 439/147
5,472,355 A * 12/1995 Wittmann ..... 439/373
6,012,941 A * 1/2000 Burdenko et al. ..... 439/373
6,071,142 A * 6/2000 Blackman ..... 439/373
6,159,034 A * 12/2000 Royer ..... 439/373
6,198,046 B1 * 3/2001 Moodie ..... 174/67
6,276,952 B1 * 8/2001 Ferranti et al. ..... 439/373
6,309,239 B1 * 10/2001 Johnston ..... 439/373
6,468,095 B2 * 10/2002 Kerr, Jr. et al. ..... 439/373

* cited by examiner

*Primary Examiner*—Gary Paumen

(57) ABSTRACT

A electrical outlet protection device for preventing power cords from falling out or being pulled out of electrical outlets. The electrical outlet protection device includes a cover assembly including a first cover member having a main wall, top and bottom walls, and a side wall, and also including a second cover member having a main wall, top and bottom wall, and a side wall with the first cover member being in contactable relationship with the second cover member and with the cover assembly being adapted to be fastenable with fasteners over an electrical outlet; and also includes semi-circular support members being attached to the top and bottom walls of the first and second cover members for fastening the cover assembly to the electrical outlet; and further includes semi-circular pad members being disposed upon the first and second cover members for engaging a power cord being plugged into the electrical outlet.

8 Claims, 3 Drawing Sheets

ELECTRICAL OUTLET PROTECTION DEVICE

BACKGROUND OF THE INVENTION

1. Field of the Invention

The present invention relates to electrical outlet covers and more particularly pertains to a new electrical outlet protection device for preventing power cords from falling out or being pulled out of electrical outlets.

2. Description of the Prior Art

The use of electrical outlet covers is known in the prior art. More specifically, electrical outlet covers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 6,159,034; 5,174,773; 6,198,046; 2,761,112; and U.S. Pat. No. Des. 283,221.

While these devices fulfill their respective, particular objectives and requirements, the aforementioned patents do not disclose a new electrical outlet protection device. The prior art describes inventions having plates being hingedly attached to the electrical outlets.

SUMMARY OF THE INVENTION

The general purpose of the present invention, which will be described subsequently in greater detail, is to provide a new electrical outlet protection device which has many of the advantages of the electrical outlet covers mentioned heretofore and many novel features that result in a new electrical outlet protection device which is not anticipated, rendered obvious, suggested, or even implied by any of the prior art electrical outlet covers, either alone or in any combination thereof. The present invention includes a cover assembly including a first cover member having a main wall, top and bottom walls, and a side wall, and also including a second cover member having a main wall, top and bottom wall, and a side wall with the first cover member being in contactable relationship with the second cover member and with the cover assembly being adapted to be fastenable with fasteners over an electrical outlet; and also includes semi-circular support members being attached to the top and bottom walls of the first and second cover members for fastening the cover assembly to the electrical outlet; and further includes semi-circular pad members being disposed upon the first and second cover members for engaging a power cord being plugged into the electrical outlet. None of the prior art includes the combination of the elements of the present invention.

There has thus been outlined, rather broadly, the more important features of the electrical outlet protection device in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new electrical outlet protection device which has many of the advantages of the electrical outlet covers mentioned heretofore and many novel features that result in a new electrical outlet protection device which is not anticipated, rendered obvious, suggested, or even implied by any of the prior art electrical outlet covers, either alone or in any combination thereof.

Still another object of the present invention is to provide a new electrical outlet protection device for preventing power cords from falling out or being pulled out of electrical outlets.

Still yet another object of the present invention is to provide a new electrical outlet protection device that is easy and convenient to set up and use.

Even still another object of the present invention is to provide a new electrical outlet protection device that prevents damage to the power cords and electrical sockets.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
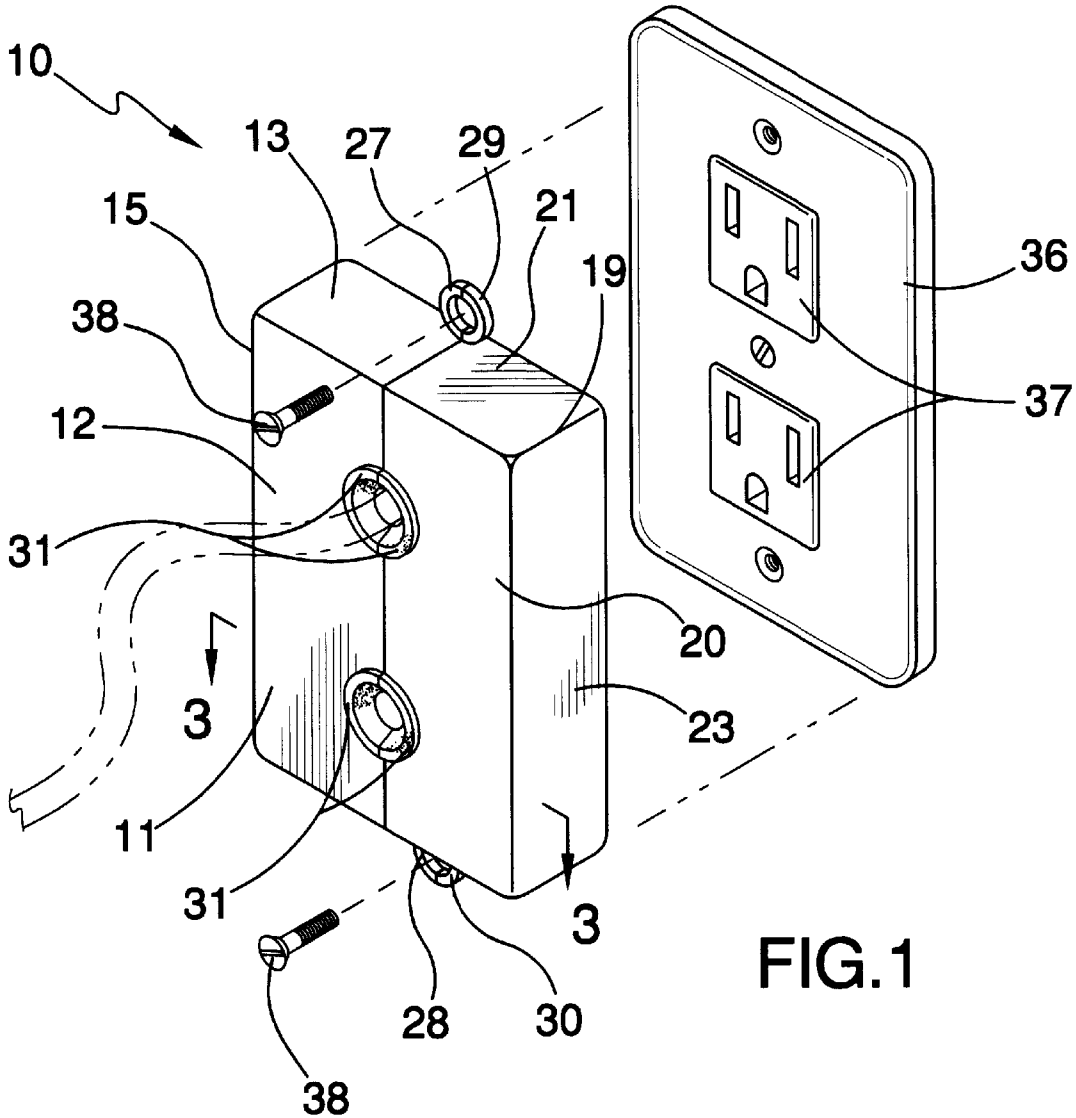
FIG. 1 is a front elevational view of a new electrical outlet protection device according to the present invention.
Figure 2:
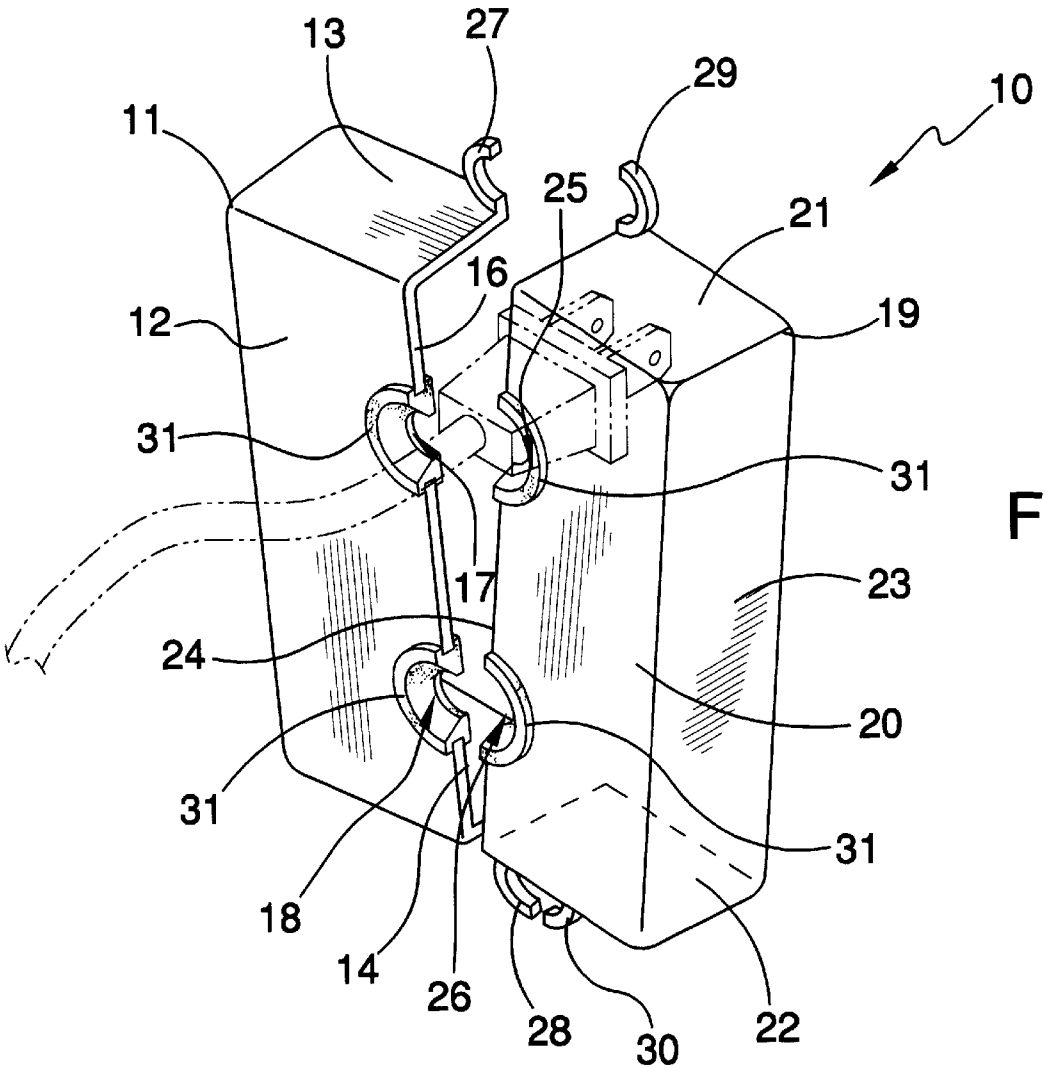
FIG. 2 is an exploded perspective view of the present invention.
Figure 3:
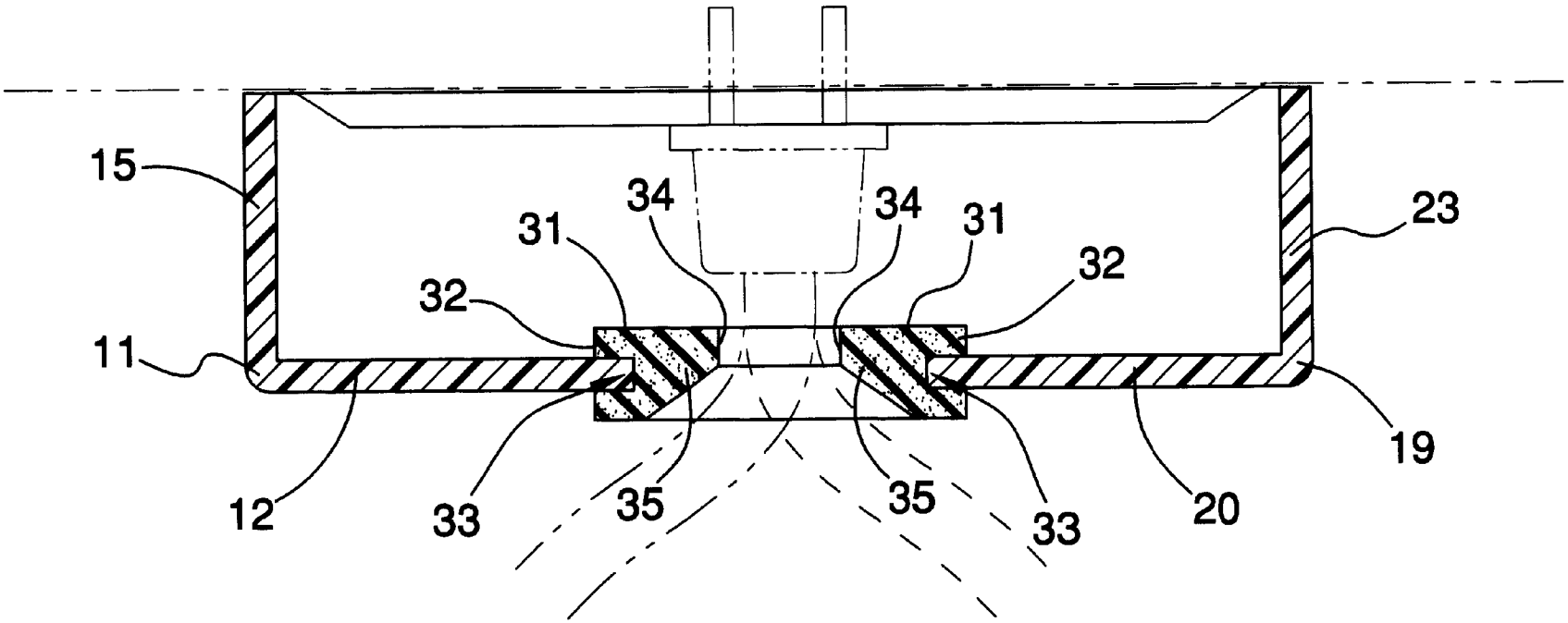
FIG. 3 is a cross-sectional view of the present invention.

With reference now to the drawings, and in particular to FIGS. 1 through 3 thereof, a new electrical outlet protection device embodying the principles and concepts of the present invention and generally designated by the reference numeral 10 will be described.

As best illustrated in FIGS. 1 through 3, the electrical outlet protection device 10 generally comprises a cover assembly including a first cover member 11 having a main wall 12, top and bottom walls 13,14, and a side wall 15, and also including a second cover member 19 having a main wall 20, top and bottom wall 21,22, and a side wall 23 with the first cover member 11 being in contactable relationship with the second cover member 19. The cover assembly is adapted to be fastenable with fasteners 38 over an electrical outlet 36. The first and second cover members 11,19 have longitudinal edges 16,24 which are in contactable relationship to one another upon the first and second cover members 11,19 being fastened upon the electrical outlet 36. Each of the first and second cover members 11,19 also has a pair of semi-circular slots 17,18,25,26 being spacedly disposed in the longitudinal edge 16,24 of the main wall 12,20. Each semi-circular slot 17,18 of the first cover member 11 is aligned with a respective one of the semi-circular slots 25,26 of the second cover member 19 thus forming holes upon the first and second cover members 11,19 being in contact with one another and being fastened over the electrical outlet 36. The holes are adapted to be aligned with the sockets 37 of the electrical outlet 36 upon the first and second cover members 11,19 being fastened over the electrical outlet 36. The first and second cover members 11,19 are generally mirrored halves of one another.

Semi-circular support members 27–30 are conventionally attached to the top and bottom walls 13,14, 21,22 of the first and second cover members 11,19 for fastening the cover assembly to the electrical outlet 36. The semi-circular support members 27–30 are disposed near the longitudinal edges 16,24 of the first and second cover members 11,19 and form grommets upon the first and second cover members 11,19 being in contact with one another.

Semi-circular pad members 31 are conventionally disposed upon the first and second cover members 11,19 for engaging a power cord being plugged into the electrical outlet 36. The semi-circular pad members 31 are engaged in the semi-circular slots 17,18,25,26 with each of the semi-circular pad members 31 having a convex outer side 32 with an arcuate groove 33 being disposed therein and engaging an edge of a respective one of the semi-circular slots 17,18,25, 26 and also having a concave inner side 34,35. The concave inner side 34,35 includes a rear portion 34 which is generally parallel to the convex outer side 33, and also includes a front portion 35 which is angled relative to the rear portion 34 and slanted from the rear portion 34 toward the convex outer side 33.

In use, the user places the first and second cover members longitudinal edge 16 to longitudinal edge 24 about one or more power cords which are disposed through the holes formed by the semi-circular slots 17,18,25,26, and inserts the fasteners through the grommets and into the electrical outlet 36 to securely fasten the cover assembly thereto to prevent the power cords from being pulled out of the sockets 37.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, .materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the electrical outlet protection device. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A electrical outlet protection device comprising:

a cover assembly including a first cover member having a main wall, top and bottom walls, and a side wall, and also including a second cover member having a main wall, top and bottom wall, and a side wall, said first cover member being in contactable relationship with said second cover member, said cover assembly being adapted to be fastenable with fasteners over an electrical outlet;

semi-circular support members being attached to said top and bottom walls of said first and second cover members for fastening said cover assembly to the electrical outlet; and semi-circular pad members being disposed upon said first and second cover members for engaging a power cord being plugged into the electrical outlet.

2. An electrical outlet protection device as described in claim 1, wherein said first and second cover members have longitudinal edges which are in contactable relationship to one another upon said first and second cover members being fastened upon the electrical outlet.

3. An electrical outlet protection device as described in claim 2, wherein each of said first and second cover members also has a pair of semi-circular slots being spacedly disposed in said longitudinal edge of said main wall, each said semi-circular slot of said first cover member being aligned with a respective one of said semi-circular slots of said second cover member thus forming holes upon said first and second cover members being in contact with one another and being fastened over the electrical outlet.

4. An electrical outlet protection device as described in claim 3, said holes being adapted to be aligned with sockets of the electrical outlet upon said first and second cover members being fastened over the electrical outlet.

5. An electrical outlet protection device as described in claim 4, wherein said first and second cover members being generally mirrored halves of one another.

6. An electrical outlet protection device as described in claim 4, wherein said semi-circular support members are disposed near said longitudinal edges of said first and second cover members and form grommets upon said first and second cover members being in contact with one another.

7. An electrical outlet protection device as described in claim 6, wherein said semi-circular pad members are engaged in said semi-circular slots, each of said semi-circular pad members having a convex outer side with an arcuate groove being disposed therein and engaging an edge of a respective one of said semi-circular slots, and also having a concave inner side.

8. An electrical outlet protection device as described in claim 7, wherein said concave inner side includes a rear portion which is generally parallel to said convex outer side, and also includes a front portion which is angled relative to said rear portion and slanted from said rear portion toward said convex outer side.

* * * * *